US010400451B2

(12) United States Patent
Curtin et al.

(10) Patent No.: US 10,400,451 B2
(45) Date of Patent: Sep. 3, 2019

(54) COMPOSITE PANEL

(76) Inventors: Donal Curtin, Jessup, MD (US); Peter Simko, Caledon (CA); Donal McCullagh, Caledon (CA)

( * ) Notice: Subject to any disclaimer, the term of this patent is extended or adjusted under 35 U.S.C. 154(b) by 0 days.

(21) Appl. No.: 13/497,694

(22) PCT Filed: Oct. 18, 2010

(86) PCT No.: PCT/IE2010/000059
§ 371 (c)(1),
(2), (4) Date: May 30, 2012

(87) PCT Pub. No.: WO2011/045778
PCT Pub. Date: Apr. 21, 2011

(65) Prior Publication Data

US 2012/0231231 A1 Sep. 13, 2012

Related U.S. Application Data

(60) Provisional application No. 61/272,657, filed on Oct. 16, 2009.

(51) Int. Cl.
*E04C 2/36* (2006.01)
*E04C 2/292* (2006.01)

(52) U.S. Cl.
CPC ..... *E04C 2/292* (2013.01); *E04C 2/36* (2013.01); *Y10T 428/24777* (2015.01); *Y10T 428/249923* (2015.04); *Y10T 428/249953* (2015.04)

(58) Field of Classification Search
CPC ..... E04C 2/384; E04C 2/205; E04C 2/292; E04C 2/296; E04C 2003/0473; E04C 3/36; E04B 7/22; E04B 1/24
(Continued)

(56) References Cited

U.S. PATENT DOCUMENTS 2,739,677 A * 3/1956 Greulich ..... E04C 2/292 105/423
3,313,073 A * 4/1967 Mathews ..... E04B 1/76 52/309.11
(Continued)

FOREIGN PATENT DOCUMENTS

EP 2045409 A1 4/2009
GB 2227712 A 8/1990
(Continued)

OTHER PUBLICATIONS

International Preliminary Report on Patentability, IB Geneva, dated Apr. 17, 2012, incorporating the Written Opinion of the ISA, ISA/EP, Rijswijk, NL, dated Mar. 18, 2011.
(Continued)

*Primary Examiner* — Basil S Katcheves
*Assistant Examiner* — Omar F Hijaz
(74) *Attorney, Agent, or Firm* — Harness, Dickey & Pierce, P.L.C.

(57) ABSTRACT

An insulating panel (1) comprises a first sheet (2), a second sheet (3) with an insulating foam (4) therebetween. The foam may, for example be a polyurethane foam, polyisocyanurate foam or a phenolic foam. The first and second sheets (2, 3) are metal such as steel, for example a galvanised or coated sheet. At least one reinforcing element (20) is provided within the insulating foam (body (4) and extends between the first and second sheets (2, 3). The reinforcing element (20) extends longitudinally along at least part of the length of the panel (1). For enhanced structural strength there are at least two reinforcing elements (20) which are spaced-apart between the side marginal edges of the panel (1). The reinforcing element (20) comprises a first flange (21), a second flange (22) and a web (23) extending between the flanges. The reinforcing element (20) is adapted to interengage with the insulating foam body (4) during manu-
(Continued)

facture. The element (20) has a plurality of through holes (25) at least in the web (23) thereof to facilitate passage of reacting foam. The web may also have keying features such as ribs (29) or the like. The ribs (29) may be pressed out to enhance the structural strength/stiffness of the elements (27). Similarly, the metal in the region of the holes (25) may be provided with pressed ribs to enhance structural strength.

20 Claims, 5 Drawing Sheets

(58) Field of Classification Search
USPC ..... 52/309.1–309.4, 309.7, 309.16, 309.13
See application file for complete search history.

(56) References Cited

U.S. PATENT DOCUMENTS 3,733,232 A * 5/1973 Payne ..... B32B 27/00 156/290
3,884,009 A 5/1975 Frohlich et al.
3,971,184 A 7/1976 Van Wagoner
4,128,975 A * 12/1978 Abate ..... 52/125.4
4,288,962 A * 9/1981 Kavanaugh ..... 52/742.13
4,747,247 A 5/1988 Petersen, Jr. et al.
4,996,812 A 3/1991 Venable
5,279,089 A * 1/1994 Gulur ..... 52/309.11
6,167,624 B1 * 1/2001 Lanahan et al. ..... 29/897.32
6,233,892 B1 * 5/2001 Tylman ..... 52/309.12
6,276,104 B1 * 8/2001 Long et al. ..... 52/309.4
6,298,622 B1 * 10/2001 Cretti ..... 52/309.7
6,679,018 B2 1/2004 Georgeau et al.
6,742,313 B2 6/2004 Ritland et al.
6,796,093 B2 * 9/2004 Brandes ..... 52/309.8
6,938,386 B2 9/2005 Ritland et al.
7,454,876 B2 11/2008 Kelly
7,493,733 B2 2/2009 Kelly
7,526,903 B2 * 5/2009 Kandasamy ..... F24F 3/0442 52/588.1
7,543,419 B2 * 6/2009 Rue ..... E04C 2/22 52/309.16
7,607,271 B2 10/2009 Griffin et al.
7,658,052 B2 2/2010 Kelly
7,793,479 B2 9/2010 Kelly
7,877,955 B2 2/2011 Kelly
7,963,080 B1 * 6/2011 Bowman ..... 52/414
7,964,272 B2 * 6/2011 Guevara et al. ..... 428/312.4
8,176,696 B2 * 5/2012 LeBlang ..... 52/309.12
2004/0107662 A1 6/2004 Georgeau et al.
2005/0011155 A1 1/2005 Ponting et al.
2005/0188649 A1 * 9/2005 Hagen, Jr. ..... B29C 44/186 52/782.1
2006/0052016 A1 3/2006 Ritland et al.
2006/0201090 A1 * 9/2006 Guevara et al. ..... 52/309.12
2007/0207305 A1 * 9/2007 Hord ..... B32B 7/02 428/304.4
2008/0006002 A1 * 1/2008 Strickland ..... E04C 3/07 52/843
2009/0165412 A1 * 7/2009 Flynn ..... E04C 2/292 52/309.3
2009/0186541 A1 7/2009 Carolan et al.

FOREIGN PATENT DOCUMENTS

GB 2257086 A 1/1993
GB 2325640 A 12/1998

OTHER PUBLICATIONS

International Search Report for PCT/IE2010/000059, ISA/EP, Rijswijk, NL, dated Mar. 18, 2011.

* cited by examiner 1
2
3
4
5
6
7
8
10
20
22

COMPOSITE PANEL

CROSS-REFERENCE TO RELATED APPLICATIONS

This is a national stage of PCT/IE10/000059 filed Oct. 18, 2010 and published in English, claiming benefit of U.S. provisional application No. 61/272,657, filed Oct. 16, 2009, hereby incorporated by reference.

INTRODUCTION

With increasing energy costs there is a need for minimising the costs of cladding a building.

This invention is directed towards providing an improved insulating panel which will address this issue.

STATEMENTS OF INVENTION

According to the invention there is provided a composite panel comprising:

a first sheet;

a second sheet;

an insulating body between the first and second sheets; and a reinforcing element within the insulating body In one embodiment the reinforcing element is located intermediate the side edges of the panel. The reinforcing element may extend between the first sheet and the second sheet.

In one case the reinforcing element extends longitudinally along at least portion of the length of the panel.

In one embodiment the insulating body extends through the reinforcing element.

The reinforcing element may comprise holes or gaps through which the insulating body extends. The reinforcing element may comprise keying features.

In one case the reinforcing element comprises a structural beam.

The reinforcing element may comprise a first flange, a second flange and a web extends between the flanges. In one case the first flange and the second flange extend from the web in the same direction. Alternatively, the first flange and the second flange extend from the web in opposite directions.

In one case the web extends from the first flange to the second flange in a substantially straight section.

The element may be substantially "C" shaped.

In another embodiment the web member comprises a non-straight section between the flanges. The web may comprise an indented section between the flanges.

The element may be substantially "sigma" shaped.

In one embodiment insulation means is provided between the reinforcing element and the first and second sheets. The insulation means may comprise an insulating tape. The insulating means may be adhesively bonded to the adjacent sheet and/or to the reinforcing element.

The first sheet may be substantially flat or may be profiled.

The second sheet may be substantially flat or may be profiled.

In one case the first sheet is of metal such as steel.

In one case the second sheet is of metal such as steel.

The reinforcing element may be of metal such as steel.

In one embodiment the insulating body comprises a foam such as a polyisocyanurate foam, or a phenolic foam.

The panel may be a roof panel, a wall panel or a floor panel.

The invention also provides a method for manufacturing a reinforced composite panel comprising the steps of:

leading a first sheet to a reinforcing element application station;

bonding a reinforcing element to the first sheet;

laying liquid foam reactants onto the first sheet;

applying a second sheet to the reinforcing element; and allowing the liquid foam reactants to expand to form a foam insulating body between the first and second sheets, the reinforcing element being embedded within the foam.

The method may comprise providing an insulating strip or tape between the reinforcing element and the first and second sheets. The method may comprise adhesively bonding the insulating strip or tape to the reinforcing element and to the respective sheet.

BRIEF DESCRIPTION OF THE DRAWINGS

The invention will be more clearly understood from the following description thereof given by way of example only, in which.

DETAILED DESCRIPTION

Figures 1, 2, 3:
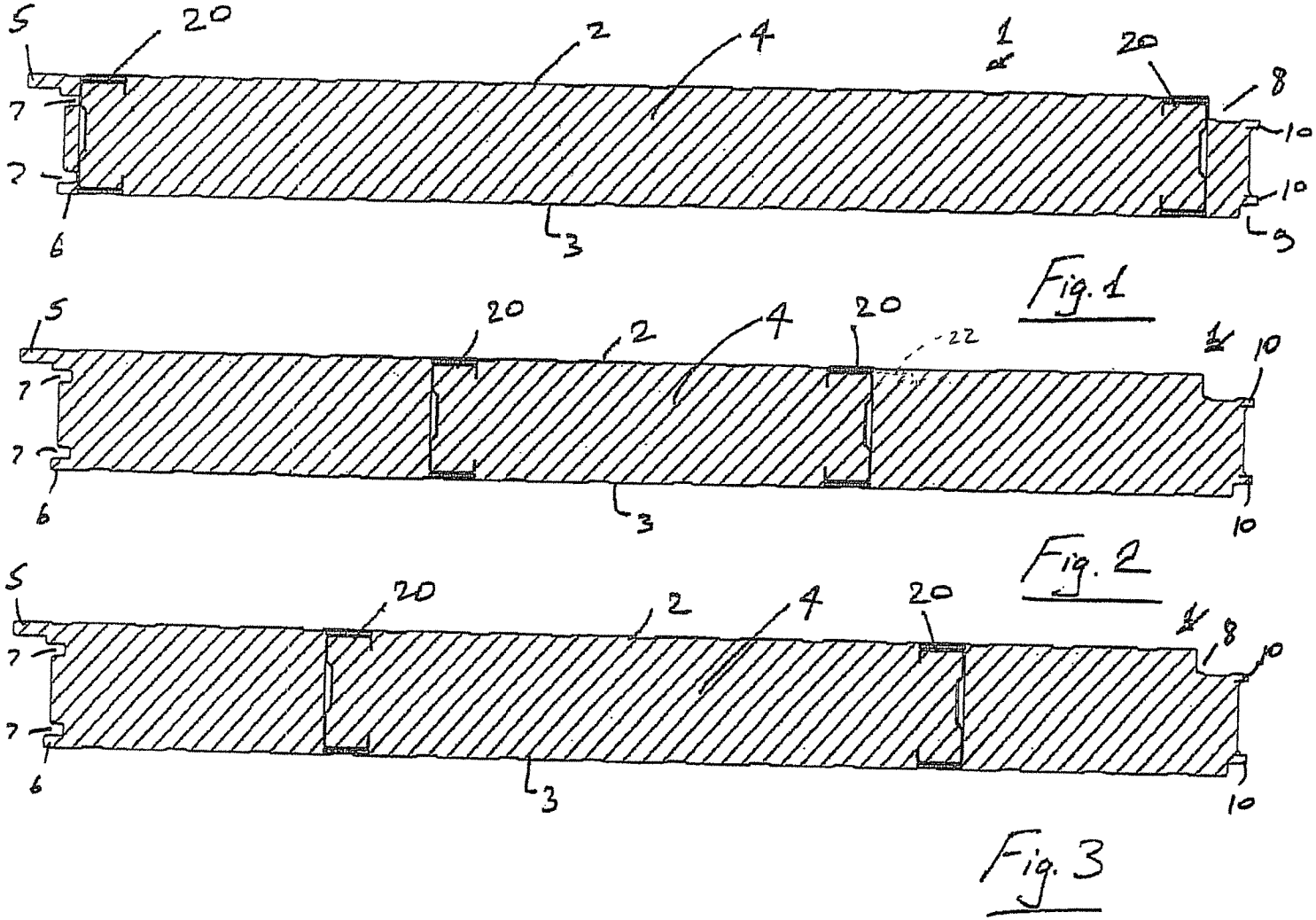
FIG. 1 is a cross sectional view of an insulating panel of the invention.
FIG. 2 is a cross sectional view of another insulating panel of the invention.
FIG. 3 is a cross sectional view of a further insulating panel of the invention.

Referring to the drawings there is illustrated an insulating panel 1 according to the invention 10 comprising a first sheet 2, a second sheet 3 with an insulating body, in this case an insulating foam 4 therebetween. The foam may, for example be a polyurethane foam, polyisocyanurate foam or a phenolic foam.

Figure 7:
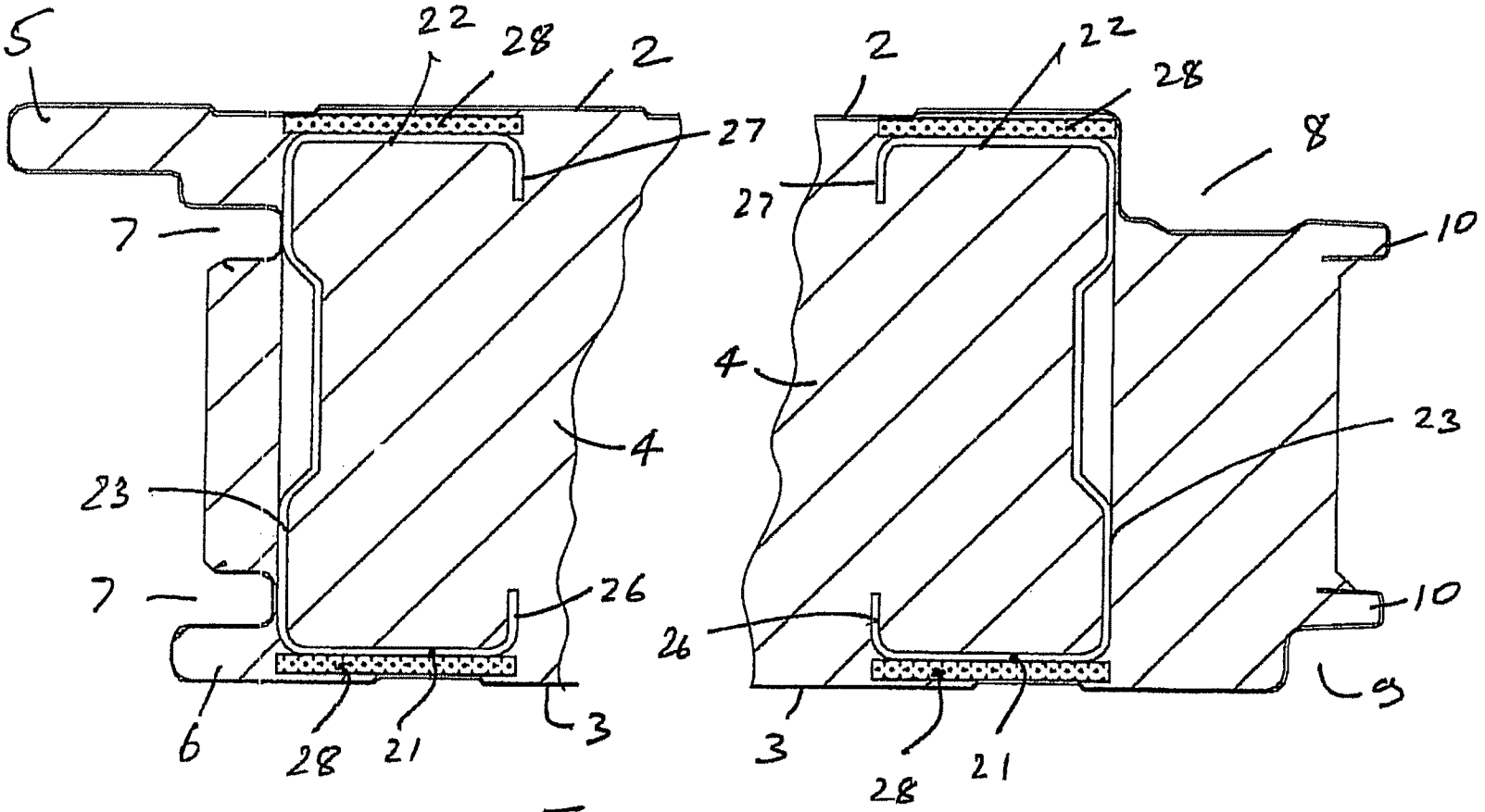
FIG. 7 is an enlarged cross sectional view of an insulating panel of the invention.
Figure 8:
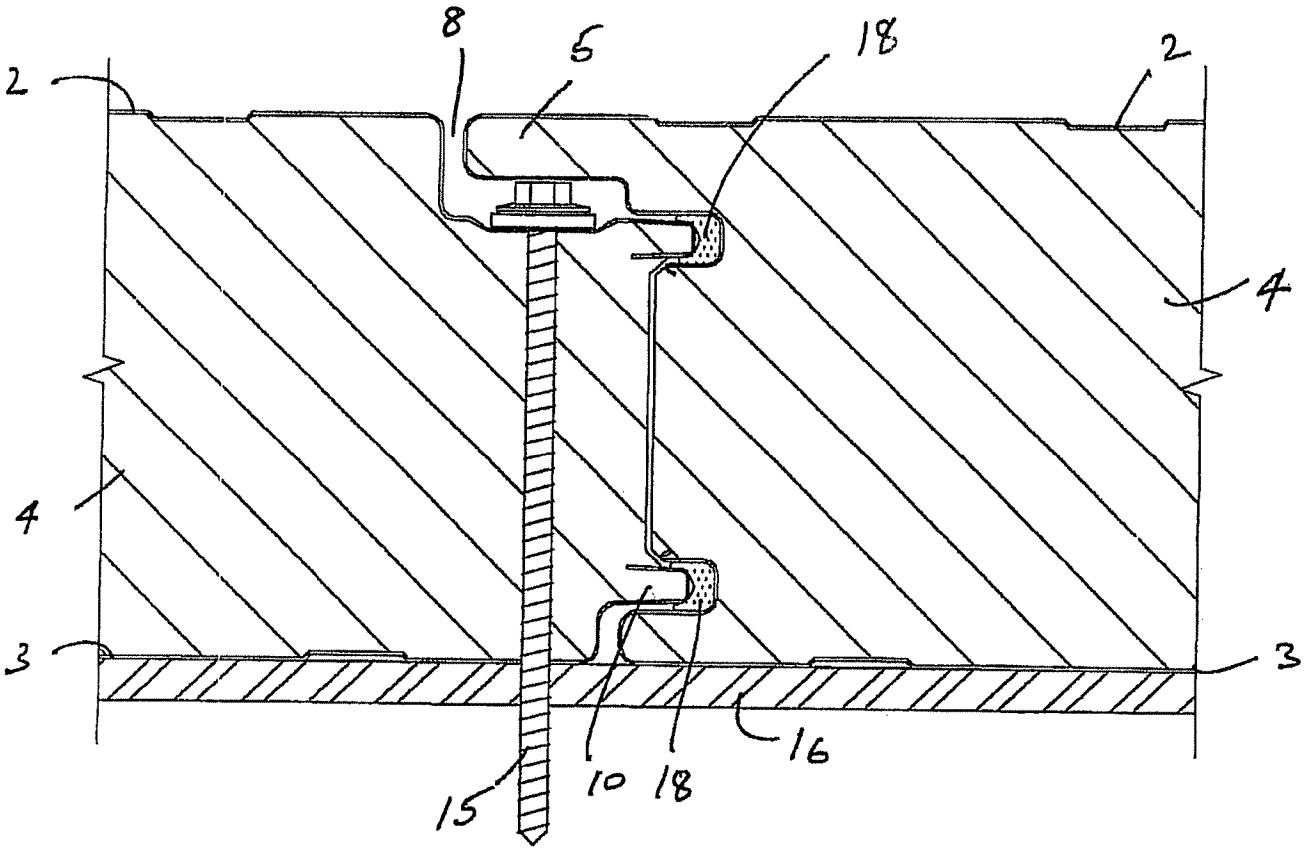
FIG. 8 is a cross sectional view of an assembled joint between adjacent panels.

The first and second sheets 2, 3 are in this case of metal such as steel, for example a galvanised or coated sheet. In this case the sheets 2, 3 are substantially flat with relatively minor profile features to provide aesthetically pleasing surfaces. The panel also has joint forming male formations 5, 6 and female recesses 7 along one edge and corresponding female recesses 8, 9 and male formations 10 along the opposite edge. The male and female formations inter-engage on assembly of one panel with an adjacent like panel as will be particularly apparent from FIGS. 7 and 8. Fixings 15 may be used to secure the assembly to an underlying support 16 as illustrated in FIG. 8. It will be noted that on assembly, the male formation 5 extends to occlude the fixings 15. Various seals 18 may be provided at the joint between the panels.

At least one reinforcing element 20 is provided within the insulating foam body 4 and extends between the first and second sheets 2, 3. The reinforcing element 20 extends longitudinally along at least part and in this case all of the length of the panel 1. For enhanced structural strength there are at least two reinforcing elements 20 which are spaced-apart between the side marginal edges of the panel 1. The reinforcing elements 20 may be located at any desired location to achieve enhanced structural strength. For example, as illustrated in FIG. 1 there may be two reinforcing elements 20 which are located adjacent to the side edges of the panel. Alternatively, as illustrated in FIG. 2 the reinforcing elements 20 may be located approximately equidistant from the panel side edges. The reinforcing elements may however be located at any desired spacing such as is illustrated in FIG. 3, depending on structural requirements.

Figure 4:
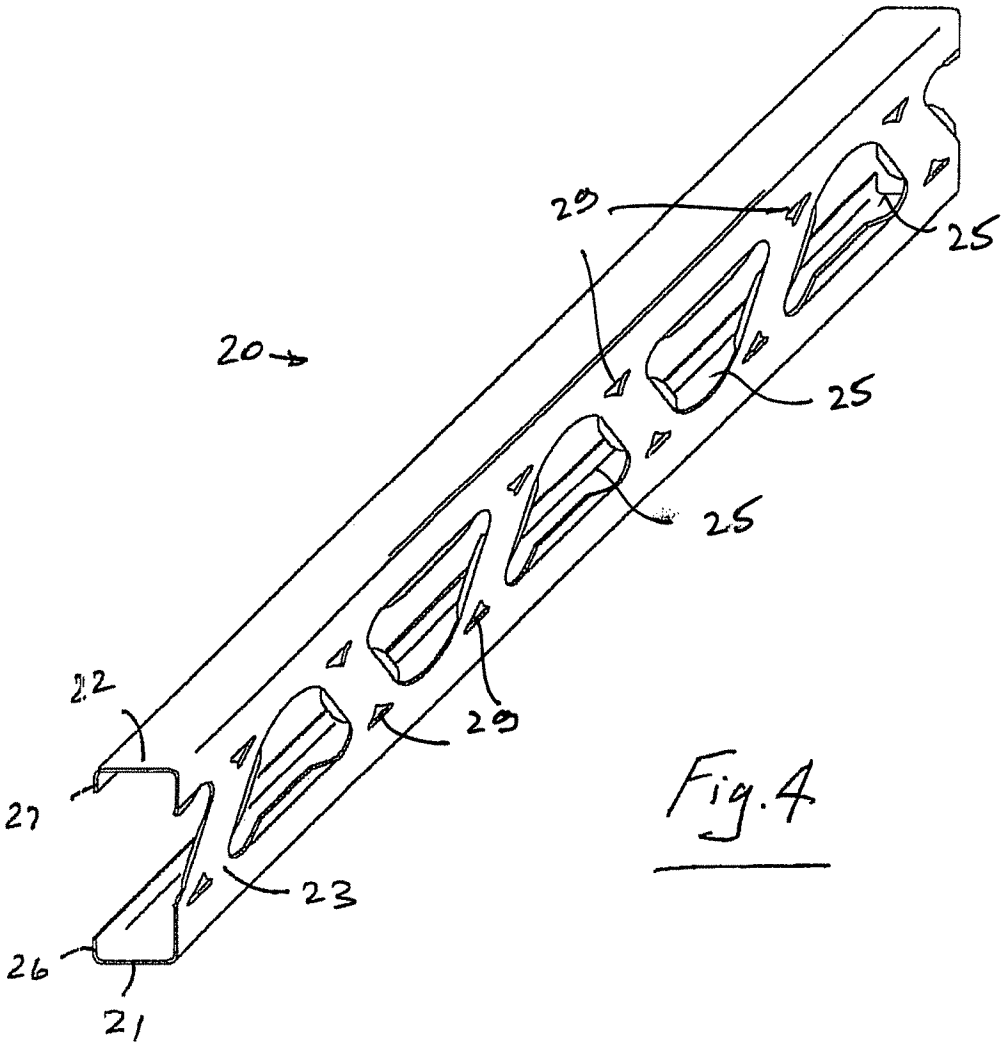
FIG. 4 is an isometric view of a reinforcing element used in the panels of the invention.
Figure 5:
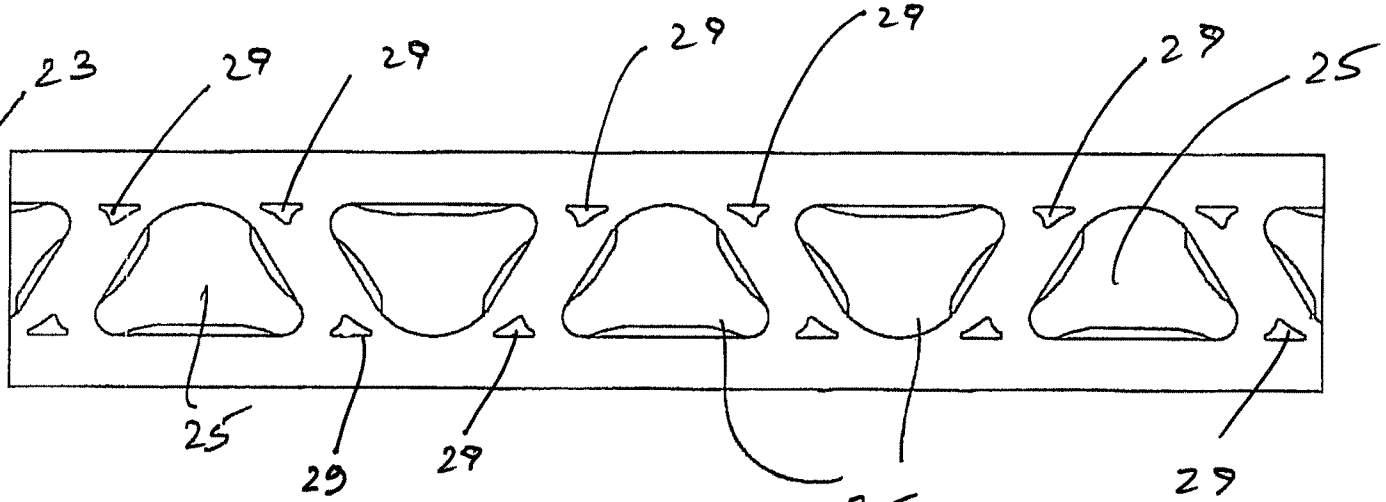
FIG. 5 is an elevational view of the reinforcing element of FIG. 4.
Figure 6:
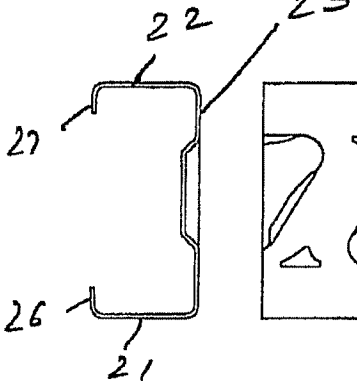
FIG. 6 is an end view of the reinforcing element of FIG. 4.

Referring especially to FIGS. 4 to 6 the reinforcing element 20 comprises a first flange 21, a second flange 22 and a web 23 extending between the flanges. In this case the first flange 21 and the second flange 22 extend from the web 23 in the same direction.

The reinforcing element also has a first return lip 26 extending from the flange 21 and a second return lip 27 extending from the flange 22. The lips 26, 27 assist in providing added structural strength. In this case the reinforcing element is of generally "C" section. Alternatively, the web 23 may have a non-straight indented section. In this case the reinforcing element 20 may have a 10 generally "sigma" shape and is provided in the form of a beam. The reinforcing element may be manufactured from any suitable material, for example steel.

The reinforcing element 20 is adapted to interengage with the insulating foam body 4 during manufacture. In this case the element 20 has a plurality of through holes 25 at least in the web 23 thereof to facilitate passage of reacting foam. There may be any number, size and shape of holes 25 which may be punched out. Additionally or alternatively the web may also have keying features such as ribs 29 or the like. The ribs 29 may be pressed out to enhance the structural strength/stiffness of the elements 27. Similarly, the metal in the region of the holes 25 may be provided with pressed ribs to enhance structural strength.

To avoid cold bridging between the first and second sheets 2, 3 the interface 5 between the flanges 21, 22 and the first and second sheets are provided with a tape or strip 28 of an insulating material. The strip 28 also provides a bond between the flanges 21, 22 and the steel sheets 2, 3.

In the invention the panel by virtue of the incorporation of the reinforcing elements have enhanced structural strength. Thus the spanning capability of the panel is greatly enhanced. This has considerable added benefits in a reduction in the steel framing required to support the panel and reduced on-site erection time.

The composite panels of the invention may be manufactured on a continuous production line by leading a first sheet 2 along a flat bed. A second sheet 3 is led to a lay-down area at which liquid foam reactants are spread across the first sheet 2 using a lay-down poker or the like. As the foam rises the second sheet 3 is applied over the foam and the sandwich thus formed is then led through an oven and subsequently cut to length. The manufacturing technology is described in our UK-A-2227712, UK-A-2257086, and UK-A-2325640, the entire contents of which are herein incorporated by reference.

A pick and place mechanism may be used to incorporate the reinforcing elements 20 during panel manufacture. Adhesive, for example in the form of tapes, may be pre-applied to some or all of the faces of the reinforcing elements. The reinforcing elements 20 are side-fed via conveyors and then a robot is used to pick a reinforcing element 20 and place it onto the first sheet 2 prior to foam lay-down. The sheet 2 is then advanced and slowed to enable the next pick and placement operation for the next reinforcing element 20. Adjacent reinforcing elements 20 may be jointed, for example by swaging so that there is no gap between adjacent reinforcing elements 20 extending along the sheet. Liquid foam reactants are spread across the first sheet 2 using a lay-down poker or the like. As the foam rises the second sheet 3 is applied over the reinforcing element 20. The holes 25 in the reinforcing element 20 facilitate passage of reacting foam so that the foam body extends through the reinforcing element 20. This ensures that the reinforcing element 20 is firmly retained within the formed composite panel. In the case of a reinforcing element of the type illustrated in FIGS. 4 to 7, insulating strips 28 are applied to the flanges 21, 22. The strip 28 attached to the first flange 21 is adhesively bonded to the inner face of the first sheet 2 during manufacture and the strip 28 attached to the second flange 22 is adhesively bonded to the inner face of the second sheet 3. The system ensures that the reinforcing elements 20 are firmly held in place during manufacture and in the finished composite panel.

It will be appreciated that the invention may be applied to a wide range of panels including roof panels, wall panels, and/or floor panels.

The panels may be used to construct part of or all of the building envelope including part or all of one or more of the roof, walls and floor.

Many variations on the embodiments described will be readily apparent. Accordingly the invention is not limited to the embodiments hereinbefore described which may be varied in detail.

The invention claimed is:

1. A composite panel to be attached to an underlining support comprising:

a first metal sheet;

a second metal sheet;

male formations and female recesses along one edge of the panel and corresponding female recesses and male formations along an opposite edge of the panel, the male formations and female recesses inter-engage upon assembly of one panel with an adjacent like panel and at least one male formation extends to occlude fasteners for securing the panel to an underlying support;

a reinforcing element including a first flange, a second flange and a web extending between the flanges, the web includes a plurality of through holes extending along the entire length of the web and a plurality of keying features including indented sections or ribs, and at least one keying feature of the plurality of keying features position adjacent each hole of the plurality of holes to enhance structural strength of the reinforcing element, the first and second flange secured with the first and second metal sheets, respectively;

insulating foam tape adhered to the first and second flange prior to bonding the reinforcing element to the first and second metal sheets;

the insulating foam tape positioned between said first and second reinforcing element flanges and the first and second metal sheets to avoid cold bridging between the first and second metal sheets, the insulating foam tape adhered to the first flange of the reinforcing element bonding the first flange of the reinforcing element to the first metal sheet and the insulating foam tape on the second flange of the reinforcing element to bond the second flange of the reinforcing element to the second metal sheet so that the reinforcing element is held in position on the first metal sheet, during curing of the liquid foam reactants; and an insulating body, formed from liquid foam reactants, between the first and second metal sheets, the insulating body passing through the plurality of holes in the web and bonding with the reinforcing element within the insulating body, and the insulating body bonds with a surface of the first and second sheets and the insulating body is the continuous between the first and second sheets.

2. The panel as claimed in claim 1 wherein the reinforcing element is located intermediate of the panel.

3. The panel as claimed in claim 1 wherein the reinforcing element extends between the first metal sheet and the second metal sheet.

4. The panel as claimed in claim 1 wherein the reinforcing element extends longitudinally along at least portion of the length of the panel.

5. The panel as claimed in claim 1 wherein the reinforcing element comprises holes or gaps through which the insulating body extends.

6. The panel as claimed in claim 1 wherein the reinforcing element comprises a structural beam.

7. The panel as claimed in claim 1 wherein the first flange and the second flange extend from the web in the same direction.

8. The panel as claimed in claim 1 wherein the first flange and the second flange extend from the web in opposite directions.

9. The panel as claimed in claim 1 wherein the web extends from the first flange to the second flange in a substantially straight section.

10. The panel as claimed in claim 9 wherein the reinforcing element is substantially "C" shaped.

11. The panel as claimed in claim 1 wherein the web comprises a non-straight section between flanges.

12. The panel as claimed in claim 11 wherein the web comprises an indented section between the flanges.

13. The panel as claimed in claim 1 wherein the first sheet is substantially flat.

14. The panel as claimed in claim 1 wherein the first sheet is profiled.

15. The panel as claimed in claim 1 wherein the second sheet is substantially flat.

16. The panel as claimed in claim 1 wherein the second sheet is profiled.

17. The panel as claimed in claim 1 wherein the first sheet is steel.

18. The panel as claimed in claim 1 wherein the second sheet is steel.

19. The panel as claimed in claim 1 wherein the reinforcing element including steel.

20. The panel as claimed in claim 1 wherein the insulating body comprises a foam selected from a group comprising a polyisocyanurate foam or a phenolic foam.

* * * * *